US011535965B2

(12) United States Patent
Shen et al.

(10) Patent No.: US 11,535,965 B2
(45) Date of Patent: Dec. 27, 2022

(54) MULTI-BAR WARP KNITTED FABRIC AND KNITTING METHOD THEREOF

(71) Applicant: TIANHAI LACE CO., LTD., Guangdong (CN)

(72) Inventors: Ningyi Shen, Guangdong (CN); Xianzhong Zeng, Guangdong (CN); Lixia Fu, Guangdong (CN)

(73) Assignee: TIANHAI LACE CO., LTD., Guangdong (CN)

( * ) Notice: Subject to any disclaimer, the term of this patent is extended or adjusted under 35 U.S.C. 154(b) by 47 days.

(21) Appl. No.: 17/166,785

(22) Filed: Feb. 3, 2021

(65) Prior Publication Data

US 2022/0098769 A1 Mar. 31, 2022

(30) Foreign Application Priority Data

Sep. 28, 2020 (CN) ..... 202011045851.X

(51) Int. Cl.
*D04B 21/08* (2006.01)

(52) U.S. Cl.
CPC ..... *D04B 21/08* (2013.01)

(58) Field of Classification Search
None
See application file for complete search history.

(56) References Cited

U.S. PATENT DOCUMENTS 1,715,482 A * 6/1929 Vorck ..... D04B 21/12 66/192
4,786,549 A * 11/1988 Richards ..... D04B 21/18 156/308.2
4,918,947 A * 4/1990 Speich ..... D04B 23/12 66/203

(Continued)

FOREIGN PATENT DOCUMENTS

CN 102505325 A 6/2012
CN 206359730 U 7/2017

(Continued)

OTHER PUBLICATIONS

Edwards, Jess. "Denier Tights Guide: What 'Denier' Means and How Each Number Looks." Cosmopolitan, May 21, 2021, https://www.cosmopolitan.com/uk/fashion/style/a35344/black-tights-what-different-deniers-look-like-photos/. (Year: 2021).*
First Office Action dated Aug. 2, 2021 for related Chinese Application No. 202011045851.X.

*Primary Examiner* — Khoa D Huynh
*Assistant Examiner* — Grace Huang
(74) *Attorney, Agent, or Firm* — Burns & Levinson, LLP; Joseph M. Maraia

(57) ABSTRACT

The present invention discloses a multi-bar warp knitted fabric and a knitting method thereof. The fabric comprises a ground weave and at least one group of elastic yarns, wherein each group of elastic yarns is composed of two elastic yarns, characterized in that the two elastic yarns of each group are inlaid in opposite directions on at least 90% of the loops in one same wale of the ground weave. The (Continued)

fabric has excellent characteristics, including: in addition to maintaining the soft and comfortable hand feel and general physical properties of the fabric, the elastic yarns are not easy to wash out and fly out, and the fabric can be used with a lower finished density, thereby reducing production costs.

5 Claims, 2 Drawing Sheets

(56) References Cited

U.S. PATENT DOCUMENTS

| | | | | | |
|---|---|---|---|---|---|
| 5,250,351 | A * | 10/1993 | Kondou | ..... | D04B 21/18<br>8/149.1 |
| 5,557,950 | A * | 9/1996 | Richards | ..... | D04B 21/04<br>66/194 |
| 6,745,601 | B2 * | 6/2004 | Pierelli | ..... | D04B 21/12<br>66/195 |
| 2004/0168479 | A1 * | 9/2004 | McMurray | ..... | D04B 1/16<br>66/202 |

FOREIGN PATENT DOCUMENTS

| | | | | | |
|---|---|---|---|---|---|
| CN | 206591238 | U | 10/2017 | | |
| CN | 111172667 | A | 5/2020 | | |
| DE | 19821687 | A1 * | 11/1999 | ..... | D04B 21/18 |
| EP | 0897028 | A2 * | 10/1998 | ..... | D04B 21/18 |
| JP | 2003041465 | A | 2/2003 | | |
| JP | 2018003169 | A * | 1/2018 | ..... | D04B 21/18 |

* cited by examiner

MULTI-BAR WARP KNITTED FABRIC AND KNITTING METHOD THEREOF

CROSS REFERENCE TO RELATED APPLICATION

This application is based on and claims priority under 35 U.S.C. 119 to Chinese Patent Application No. 202011045851.X, filed on Sep. 28, 2020, in the Chinese Patent Office, the disclosure of which is herein incorporated by reference in its entirety.

TECHNICAL FIELD

The present invention relates to a multi-bar warp knitted fabric and knitting method thereof on a multi-bar knitting machine, in particular relates to a multi-bar warp knitted fabric in which elastic yarns are inlaid in opposite directions in the general ground weave.

BACKGROUND ART

Premium-end functional lace fabrics, such as sports fabrics, yoga clothing fabrics, etc., generally require good elastic elongation, which is more beneficial to putting on and taking off during wearing process and has better shape retention. The development cost of lace fabrics with such characteristic is relatively high.

In order to obtain good warp-wise elasticity for warp knitted fabrics, the desired warp-wise shrinkage is generally achieved by inlaying one elastic yarn in the ground weave. In theory, the greater the warp-wise shrinkage, the better the warp-wise elasticity. But when the warp-wise shrinkage rate reaches a certain level, the loops in the ground weave become looser, and the binding force on the elastic yarns becomes smaller. In the process of repeated wearing and washing, the elastic yarns are easily bent and deformed from the ground weave or even running out, professionally called flying out and washing out of e.g. spandex. This will not meet the washing requirements but lower the grade of clothing.

At present, the only way to solve the above-mentioned technical problem is to increase the warp-wise density of the finished product, the loom pick count, etc., which will sacrifice the elasticity of the fabric and greatly increase the cost of product development. As requirements for increasing elasticity of lace fabrics and reducing costs continue existing in the market, it can be achieved only by innovation.

SUMMARY OF THE INVENTION

For solving the problem that the conventional multi-bar warp knitted fabrics with only one elastic yarn one-needle-inlaid by one guide bar are easy to fly-out and wash-out the spandex, according to the present invention, two elastic yarns in group are always inlaid in opposite directions (i.e. inlaid oppositely) in each wale. Preferably, the two elastic yarns in group are inlaid symmetrically in opposite directions, forming a twist-like or twisted rope-like structure. The loops of such structure are more difficult to disperse due to a certain angle of twisting, which can effectively prevent the elastic yarns from flying out of the fabric during the tensile test or washing test. Preferably, the elastic yarns in all the loops or more than 90% of the loops in all wales of the fabric are inlaid in opposite directions according to this method, which can avoid the problems of spandex flying out or winding out. The fabric knitted according to this method can meet the washing requirements well and meanwhile reduce cost, even when the finished product density is very low.

According to the present invention, the above objective is achieved by a multi-bar warp knitted fabric and knitting method thereof, in which elastic yarns are inlaid in opposite directions. The fabric comprises a ground weave and at least one group of elastic yarns, each group of elastic yarns is composed of two elastic yarns, the two elastic yarns of each group are inlaid in opposite directions on at least 90% of the loops in one same wale of the ground weave.

Preferably, the two elastic yarns in each group are respectively threaded in two inlay bars that can be controlled independently.

Preferably, when the two elastic yarns are inlaid in opposite directions by the two inlay bars, the basic structure thereof can be designed independently.

Preferably, the two elastic yarns in each group are inlaid symmetrically in opposite directions, forming a twist-like or twisted rope-like structure.

Preferably, the elastic yarns contain spandex.

Preferably, the elastic yarns have a fineness of less than or equal to 1000 denier.

As an exemplary embodiment, a more extensive design is adopted: two elastic yarns are one-needle inlaid symmetrically by two inlay bars, and the inlays are denoted as follows:

Elastic yarn inlay bar 1: 1-1/0-0//,

Elastic yarn inlay bar 2: 0-0/1-1//.

Or the inlays are denoted as follows:

Elastic yarn inlay bar 1: 2-2/0-0//,

Elastic yarn inlay bar 2: 0-0/2-2//.

The technological characteristics of the fabric with the two elastic yarns inlaid symmetrically in opposite directions by two elastic yarn inlay bars are: in each wale of pillar stitch, the loops of the ground weave are wound by two elastic yarns in opposite directions, causing the loops of the ground weave to twist in a certain degree and thus greatly increase the binding force of the ground yarn loops on the elastic yarns. Even if the density of the finished product is low, it is difficult for the elastic yarns to fly out of the fabric.

In the present invention, two elastic yarn inlay bars are arranged on a conventional multi-bar warp knitting machine, for performing inlay of the elastic yarns in opposite directions on the wale loops. With the knitting method of the present invention, a more stable ground weave can be obtained, the anti-flying performance of which cannot be achieved by ordinary ground weaves, and which can greatly reduce the warp-wise density of the product. For example, as in the exemplary embodiment above, with the process of performing the inlay of elastic yarns in opposite directions by the two elastic yarn inlay bars, two elastic yarns in a group are always inlaid in opposite directions in each wale of pillar stitch, so that the two elastic yarns are mutually wound in the ground weave loops to form a stable structure.

Wherein: 1—a first elastic yarn; 2—a second elastic yarn; 3—ground weave loops; 11—ground guide bar; 12—pattern guide bar; 13—jacquard guide bar; 14—a first elastic yarn inlay guide bar; 15—a second elastic yarn inlay guide bar.

DESCRIPTION OF PREFERRED EMBODIMENTS

The technical solutions in the exemplary embodiments of the present invention will be described clearly and completely below with reference to the drawings of the present invention. Obviously, the described embodiments are only exemplary embodiments of the present invention, rather than all the embodiments. Based on the exemplary embodiments of the present invention, all other embodiments obtained by those skilled in the art without creative work shall fall within the protection scope of the present invention.

oppositely are twisted with the loops together. Such structure greatly enhances the binding force of the loops of the pillar stitch on the elastic yarns, making the ground weave more stable and not easy to disperse. Even in the case of a lower finished product density, it can pass the fly-out test and the washing test.

The following table shows the comparison of washing test between the fabric according to the present invention and the HN305E pattern fabric in the prior art. Wherein the HN305E pattern fabric as a comparative example has a ground weave, and there is only one elastic yarn (i.e. spandex yarn) inlaid in each wale of pillar stitch of the ground weave. The washing test is carried out according to the standard ISO 6330 4M F 5 Cycles, and the washing process is simulated by washing 5 times.

| Fabric | Parameter setting | Test results of washing 5 times |
|---|---|---|
| HN305E pattern fabric | loom pick count: 20<br>finished product density: 38<br>ground yarn raw materials: N2390 20D/34F, warp run-in: 980MM/R<br>jacquard yarn: N0362 20D/17F, warp run-in: 380MM/R<br>spandex yarn: E0882 70D, warp run-in: 230MM/R | severe snagging, severe fluffing |
| Fabric knitted according to the present invention | loom pick count: 20<br>finished product density: 38<br>ground yarn raw materials: N2390 20D/34F, warp run-in: 980MM/R<br>jacquard yarn: N0362 20D/17F, warp run-in: 380MM/R<br>spandex yarn 1: E0882 70D, warp run-in: 230MM/R<br>spandex yarn 2: E2072 30D, warp run-in: 400MM/R | qualified snagging, qualified fluffing |

Figure 3:
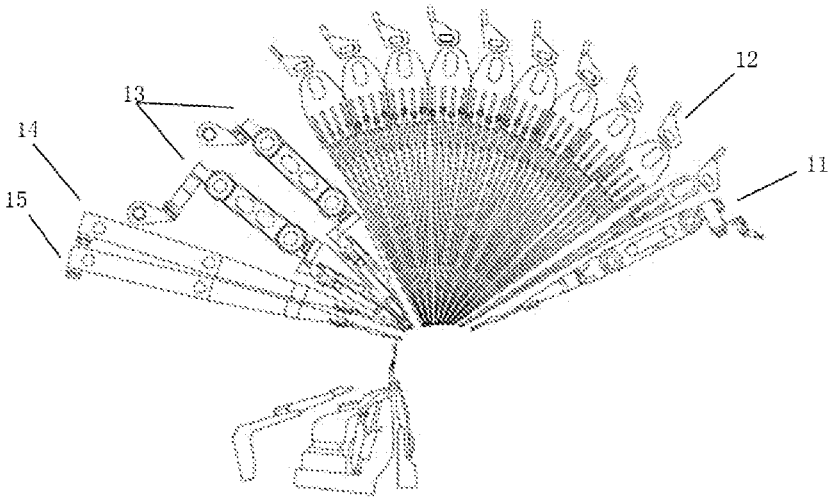
FIG. 3 shows an arrangement of the guide bars of a multi-bar warp knitting machine according to an exemplary embodiment of the present invention.

In the present invention, the two elastic yarns are inlaid in opposite directions (preferably, the two elastic yarns are inlaid symmetrically in opposite directions) by using a specific multi-bar warp knitting machine with two elastic yarn inlay bars, i.e. adding one more inlay bar to a conventional multi-bar warp knitting machine, as shown with reference numerals 14, 15 in FIG. 3. According to various types of inlay, machine control files are generated, and machine-ready pattern files in the system are generated according to the requirements of patterns and mesh in the design system.

The resulting fabric is processed according to the general multi-bar warp knitted fabric producing and finishing processes.

Figure 1:
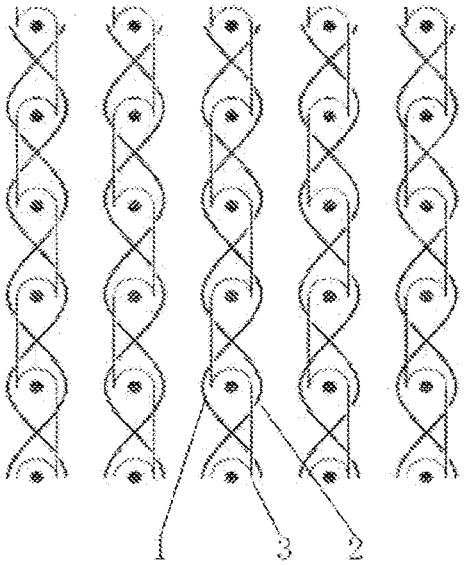
FIG. 1 is a lapping diagram of two elastic yarns inlaid in opposite directions symmetrically according to the exemplary embodiment of the present invention.
Figure 2:
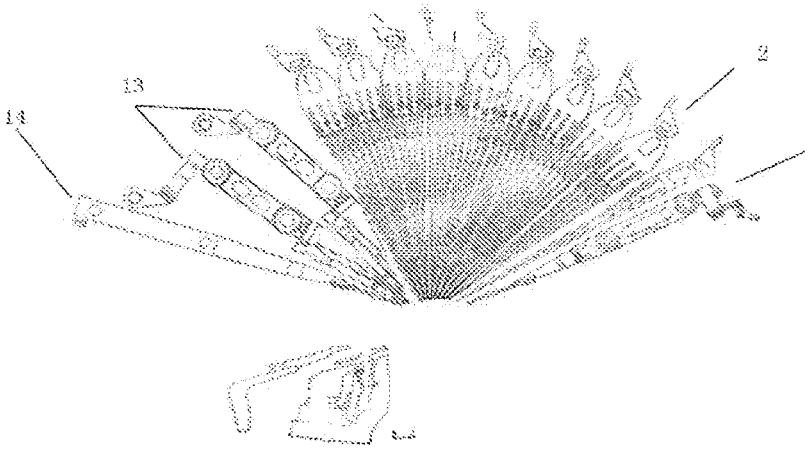
FIG. 2 Prior Art
FIG. 2 shows an arrangement of the guide bars of a multi-bar warp knitting machine in the prior art.

Example: As Shown in FIG. 1

The knitting method of inlaying elastic yarns in opposite directions symmetrically by elastic yarn inlay bars is carried out on the specific multi-bar warp knitting machine according to the present invention, and the multi-bar warp knitted fabric comprises a ground weave and elastic yarns inlaid in opposite directions, the inlay denotation, threading manner and machine gauge are expressed as follows:

The first elastic yarn inlay bar 1: 1-1/0-0//, fully threaded, 24E

The second elastic yarn inlay bar 2: 0-0/1-1//, fully threaded, 24E or expressed as follows:

The first elastic yarn inlay bar 1: 2-2/0-0//, fully threaded, 24E

The second elastic yarn inlay bar 2: 0-0/2-2//, fully threaded, 24E

In the present invention, the warp knitted fabric with two elastic yarns inlaid symmetrically in opposite directions by two elastic yarn inlay bars changes the form of loops of the pillar stitch in nature, in which the two elastic yarns inlaid The structure of the fabric of the present invention effectively solves the problems of fluffing and snagging of fabrics when washing.

The invention relates to a series of researches and developments of warp knitting machines. The elastic yarn guide bar work line is rearranged. The research and development form of the machines is not limited and will not be described in detail here. However, any form of fabrics containing two elastic yarns inlaid in opposite directions by two inlay bars on multi-bar warp knitting machines is within the protection scope of the present invention.

The foregoing are only exemplary embodiments of the application and are not intended to limit the invention. Any modification, equivalent replacement, improvement, etc. to the structure or process made within the spirit and principles of the application or applying the present invention to other relevant technical field directly or indirectly, will be covered within the scope of protection for this invention.

The invention claimed is:

1. A multi-bar warp knitted fabric, the fabric comprising a ground weave and at least one group of elastic yarns, wherein each group of elastic yarns is composed of two elastic yarns, characterized in that the two elastic yarns of each group are inlaid in opposite directions on at least 90% of the loops in one same wale of the ground weave, wherein the two elastic yarns of each group are inlaid symmetrically in opposite directions, forming a twist-like or twisted rope-like structure, in which the two elastic yarns inlaid symmetrically in opposite directions are twisted with the loops of the ground weave together, thereby enhancing the binding force of the loops of the ground weave on the elastic yarns.

2. The multi-bar warp knitted fabric according to claim 1, characterized in that one group of elastic yarns are inlaid in opposite directions on at least 90% of the loops in each wale of the ground weave.

3. The multi-bar warp knitted fabric according to claim 1, characterized in that the elastic yarns contain spandex.

4. The multi-bar warp knitted fabric according to claim 1, characterized in that the elastic yarns have a fineness of less than or equal to 1000 denier.

5. A method for knitting a multi-bar warp knitted fabric, the method comprising the steps of:

providing at least one group of elastic yarns, wherein each group of elastic yarns is composed of two elastic yarns;

inlaying the two elastic yarns of each group in opposite directions on at least 90% of the loops in one same wale of the ground weave, wherein the step of inlaying the two elastic yarns of each group in opposite directions is carried out by inlaying the two elastic yarns of each group in opposite directions symmetrically, forming a twist-like or twisted rope-like structure, the two elastic yarns inlaid in opposite directions symmetrically being twisted with the loops of the ground weave together, thereby enhancing the binding force of the loops of the ground weave on the elastic yarns.

* * * * *